US010099813B2

(12) United States Patent
Clark et al.

(10) Patent No.: US 10,099,813 B2
(45) Date of Patent: Oct. 16, 2018

(54) PALLET ASSEMBLY

(71) Applicant: Rehrig Pacific Company, Los Angeles, CA (US)

(72) Inventors: Suzanne Whitfield Clark, Santa Monica, CA (US); Dane Gin Mun Kalinowski, Foothill Ranch, CA (US); William P. Apps, Alpharetta, GA (US)

(73) Assignee: REHRIG PACIFIC COMPANY, Los Angeles, CA (US)

( * ) Notice: Subject to any disclaimer, the term of this patent is extended or adjusted under 35 U.S.C. 154(b) by 0 days.

(21) Appl. No.: 15/346,950

(22) Filed: Nov. 9, 2016

(65) Prior Publication Data

US 2017/0190467 A1 Jul. 6, 2017

Related U.S. Application Data

(60) Provisional application No. 62/252,666, filed on Nov. 9, 2015.

(51) Int. Cl.
*B65D 19/44* (2006.01)
*B65D 19/04* (2006.01)

(52) U.S. Cl.
CPC ..... *B65D 19/44* (2013.01); *B65D 19/04* (2013.01); *B65D 2519/00273* (2013.01); *B65D 2519/00293* (2013.01); *B65D 2519/00308* (2013.01); *B65D 2519/00796* (2013.01); *B65D 2519/00815* (2013.01)

(58) Field of Classification Search
CPC ..... B65D 19/44; B65D 2519/0081; B65D 2519/00815
USPC ..... 108/55.3, 55.1, 51.11
See application file for complete search history.

(56) References Cited

U.S. PATENT DOCUMENTS

| | | | | |
|---|---|---|---|---|
| 2,152,086 A * | 3/1939 | Powell | B65D 19/0022 108/57.1 |
| 2,444,326 A * | 6/1948 | Baker | B65D 19/0026 108/55.3 |
| 3,526,195 A | 9/1970 | Maryonovich | |
| 3,563,184 A | 2/1971 | Angelbeck, Jr. | |
| 3,628,468 A | 12/1971 | Angelbeck, Jr. | |
| 3,636,888 A | 1/1972 | Angelbeck, Jr. | |
| 3,948,190 A | 4/1976 | Cook, III et al. | |
| 3,993,168 A | 11/1976 | Kubick | |
| 3,995,749 A | 12/1976 | Haskins | |
| 4,263,855 A * | 4/1981 | Lawlor | B65D 19/004 108/53.3 |
| 4,344,368 A * | 8/1982 | Remington | B65D 19/0022 108/55.1 |

(Continued)

FOREIGN PATENT DOCUMENTS

WO 0006458 2/2000

*Primary Examiner* — Jose V Chen
(74) *Attorney, Agent, or Firm* — Carlson, Gaskey & Olds, P.C.

(57) ABSTRACT

A pallet includes an upper portion having an upper surface for supporting containers thereon. A first plurality of recesses in the upper surface have a first lower support surface spaced from the upper surface. A plurality of legs extend downwardly from the upper portion. The upper portion includes an overhang extending outward from one of the plurality of legs extending along each side of the pallet. In a disclosed method, containers are nested in a predetermined location on an upper surface of the pallet.

19 Claims, 19 Drawing Sheets

(56) References Cited

U.S. PATENT DOCUMENTS 4,397,247 A 8/1983 Lemelson
4,480,748 A 11/1984 Wind
4,516,677 A 5/1985 Rowland et al.
4,669,282 A 6/1987 Hoyt et al.
4,838,419 A 6/1989 Weits et al.
4,848,711 A 7/1989 Mandel
5,186,338 A 2/1993 Boutet
5,360,112 A 11/1994 Beauchamp
5,390,789 A * 2/1995 Darby ..... B65D 19/44 206/391
5,527,585 A 6/1996 Needham et al.
5,606,921 A 3/1997 Elder et al.
5,755,162 A 5/1998 Knight et al.
5,769,003 A 6/1998 Rose et al.
5,857,416 A 1/1999 Donnell, Jr. et al.
6,484,877 B1 * 11/2002 Murakami ..... B65D 19/44 108/55.3
6,609,466 B2 * 8/2003 Salmanson ..... A47B 57/22 108/107
7,997,213 B1 * 8/2011 Gauthier ..... B65D 88/129 108/53.1
9,010,255 B2 * 4/2015 Baltz ..... B65D 19/0004 108/57.13
9,315,291 B2 * 4/2016 Kelly ..... B65D 19/02
2002/0043509 A1 4/2002 Lajeunesse
2003/0110990 A1 * 6/2003 Apps ..... B65D 19/0016 108/57.25
2006/0032412 A1 * 2/2006 Harner ..... B65D 19/06 108/55.1
2006/0032413 A1 * 2/2006 Ogburn ..... B65D 19/0012 108/57.25
2006/0075939 A1 4/2006 Shuert
2006/0272556 A1 12/2006 Apps
2009/0000527 A1 * 1/2009 Ficker ..... B65D 19/0016 108/57.25
2009/0108002 A1 * 4/2009 Delbrouck ..... B62B 5/0083 220/519
2009/0145339 A1 6/2009 Dubois et al.
2010/0236456 A1 9/2010 Haaf
2011/0120353 A1 * 5/2011 Jensen ..... B65D 19/0016 108/57.25
2016/0122078 A1 * 5/2016 Clark ..... B65G 1/08 414/273
2016/0251114 A1 * 9/2016 Lee ..... B65D 19/44 108/55.3
2017/0225827 A1 * 8/2017 Ikeguchi ..... B65D 19/44

* cited by examiner

PALLET ASSEMBLY

RELATED APPLICATIONS

The application claims priority to U.S. Provisional Application No. 62/252,666 which was filed on Nov. 9, 2015.

BACKGROUND

Pallets are often used to transport goods. Pallets may include an upper deck supported above the floor so that the tines of a forklift or pallet lift jack can be inserted below the deck to lift the pallet with the goods stacked directly thereon. Alternatively, pallets with goods stacked directly thereon may be stacked and stored to allow access to the goods at a later time.

SUMMARY

A pallet includes an upper portion having an upper surface for supporting containers thereon. A first plurality of recesses in the upper surface have a first lower support surface spaced from the upper surface. A plurality of legs extend downwardly from the upper portion. The upper portion includes an overhang extending outward from one of the plurality of legs extending along each side of the pallet. In a disclosed method, containers are nested in a predetermined location on an upper surface of the pallet.

DETAILED DESCRIPTION

Figure 1:
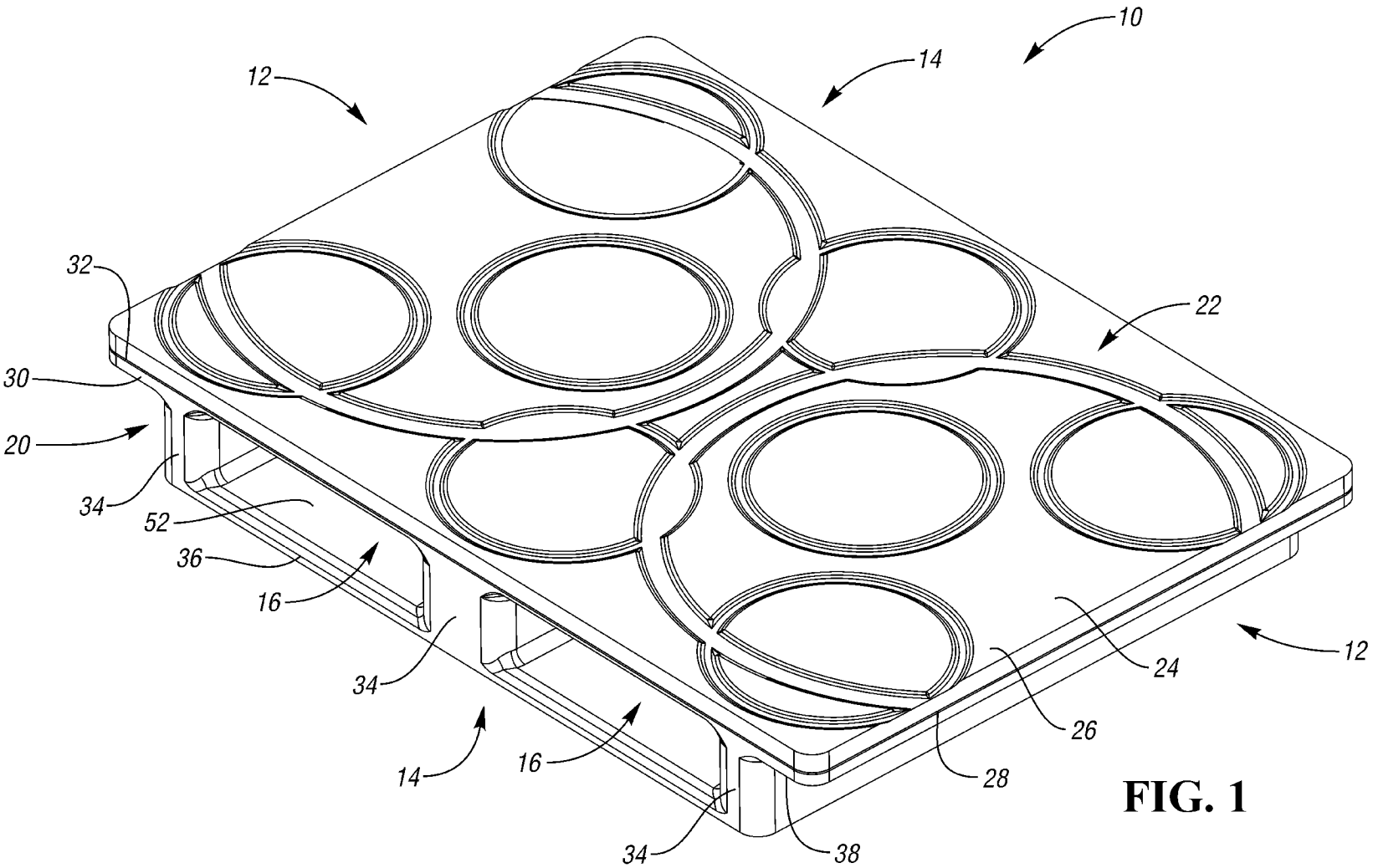
FIG. 1 is a perspective view of a pallet according to a first embodiment.

FIG. 1 illustrates a pallet 10 according to a first embodiment. The pallet 10 assists in palletizing goods, such as pails or barrels, in a desired orientation to maximize storage of the goods while balancing the load distribution through providing a predetermined stacking configuration. The pallet 10 includes a pair of opposing sides 12 and a pair of opposing ends 14. The pair of opposing ends 14 of the pallet 10 include fork openings 16 for accepting forks to assist in transporting the pallet 10.

The pallet 10 is formed from a lower structure 20 that mates with an upper structure 22. In the illustrated embodiment, the upper and lower structures 22, 20 are made from an injection molding process. The upper structure 22 includes a first upper deck portion 24 having a support surface 26 for supporting goods thereon and a lower surface 28 opposite the support surface 26.

The lower structure 20 includes a second upper deck portion 30 having an upper surface 32 corresponding in size with the lower surface 28 on the first upper deck portion 24 to form an upper portion of the pallet 10. The lower structure 20 and the upper structure 22 are attached by mating the upper surface 32 on the lower structure 20 with the lower surface 28 on the upper structure 22. The upper and lower structures 22, 20 can be mated through hot plate welding, vibration welding, or another suitable attachment technique. In another embodiment, composite or metal reinforcements (not shown) could be located between the first upper deck portion 24 and the second upper deck portion 30 to increase the rigidity of the pallet 10.

The second upper deck portion 30 includes a lower surface 33 opposite the upper surface 32. Legs 34 extend downward from the second upper deck portion 30 to lower supports 36 extending between and connecting adjacent legs 34, which adds rigidity to the pallet 10. The lower supports 36 are located on an opposite side of the legs 34 from the lower surface 33. The second upper deck portion 30, the legs 34, and the lower supports 36 are injection molded as a single piece of material in the illustrated embodiment.

Figure 2:
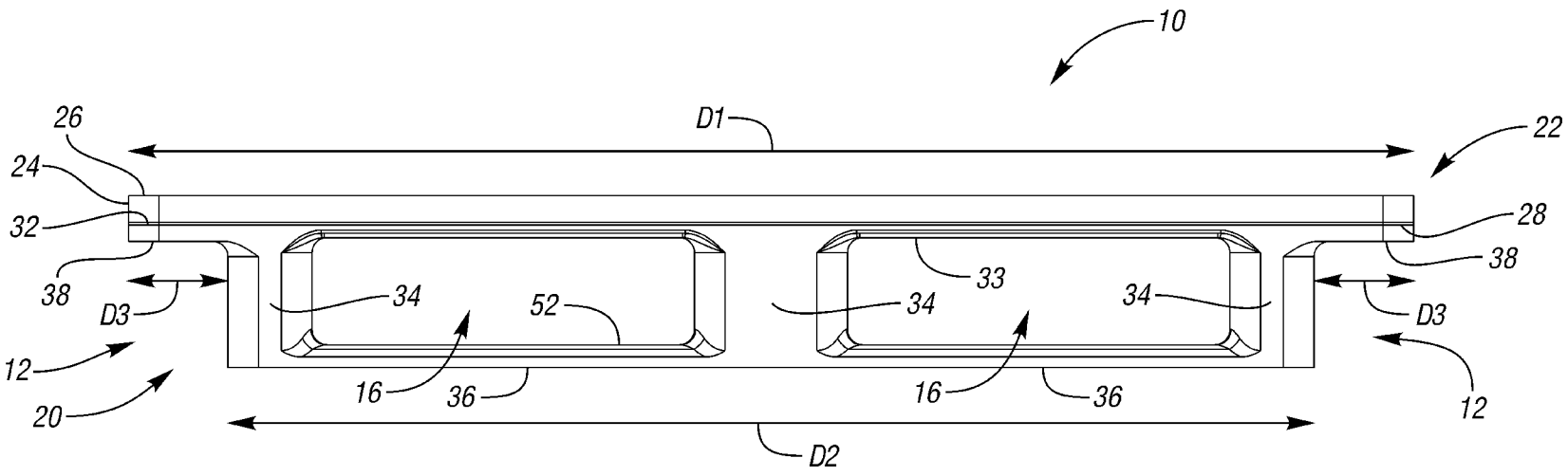
FIG. 2 is a front view of the pallet of FIG. 1.

FIG. 2 illustrates a front view of the pallet 10 showing the first and second upper deck portions 24, 30 having a first dimension D1 extending across a width of the first and second upper deck portions 24, 30. Opposing exterior surfaces of the legs 34 adjacent the sides 12 have a second dimension D2 extending across a width of the pallet 10. In the illustrated embodiment, the first dimension D1 is greater than the second dimension D2 such that the first and second upper deck portions 24, 30 extend a distance D3 from the opposing exterior surfaces of the legs 34 adjacent the sides 12 of the pallet 10.

By having the first and second upper deck portions 24, 30 extend outward beyond the lower support 36 and the legs 34, a recessed surface 38 is formed on the lower surface 33 defining a negative space or void. Additionally, the support surface 26 will have more surface area for supporting goods compared to a foot print of the lower support 36 and legs 34 of the pallet 10. The recessed surface 38 allows the pallet 10 to interface with a racking system in place. Because negative space exists adjacent the recessed surface 38, the pallet 10 can slide onto rails in a racking system where the lower supports 36 and or legs 34 connect with rails to support a load on the pallet 10. In the illustrated example, the recessed surface 38 does not support the load on the pallet 10 in the racking system. However, the recessed surface 38 could provide an additional point of contact when inserting into the pallet 10 into the racking system if the rails on the racking system were sized to contact the recessed surfaces 38 while stilling contacting the lower support 36 for a majority of the support for the pallet 10.

Figure 3:
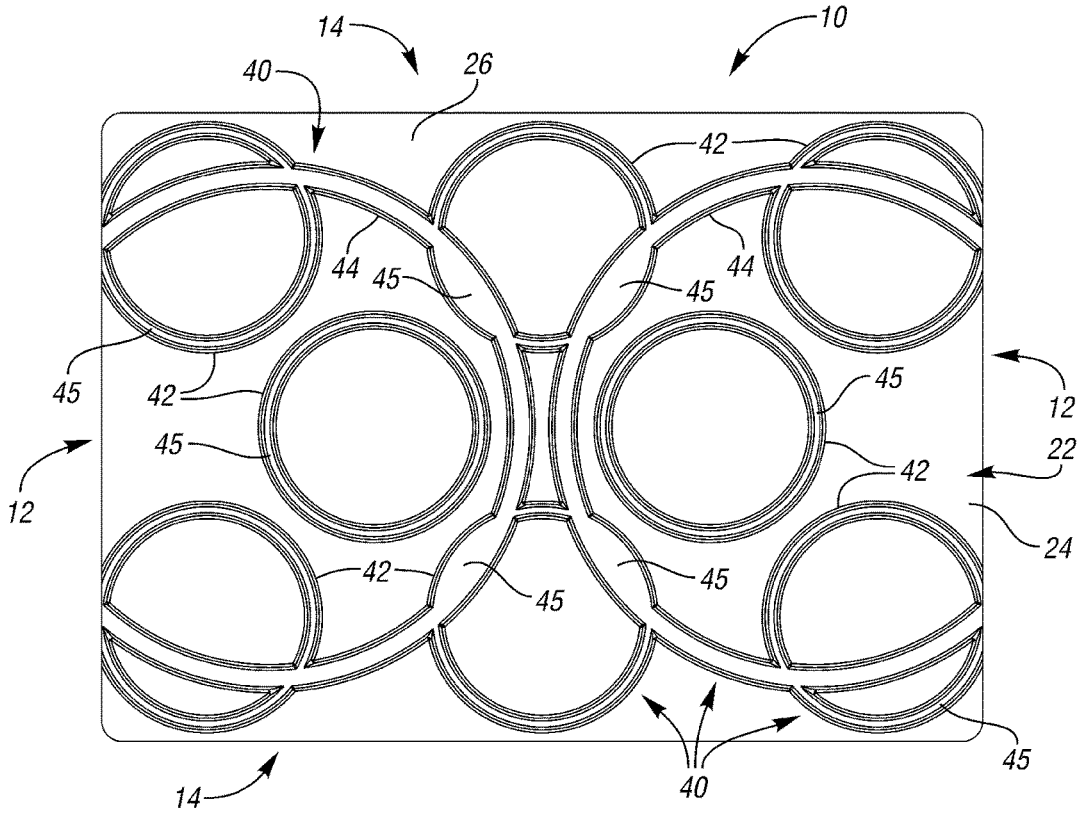
FIG. 3 is a top view of the pallet of FIG. 1.

FIG. 3 illustrates a top view of the pallet 10 showing the support surface 26 on the first upper deck portion 24 of the upper structure 22. The support surface 26 includes a plurality of aligning impressions 40 recessed into the support surface 26. In the illustrated embodiment, each of the aligning impressions 40 includes a complete or partial ring shape that at least partially circumscribes a geometric shape, such as a circle having a first or second dimension, for accepting a base portion of goods stacked thereon, such as pails or barrels. The aligning impressions 40 reduce the amount of time required to load the pallet 10 by providing predetermined locations for best supporting and stacking the goods. Additionally, by providing predetermined locations for the goods, the pallet 10 can stacked with an equal weight distribution to increase stability and maneuverability of transporting the pallet 10 when loaded.

In the illustrated embodiment, the aligning impressions 40 include a first plurality of aligning impressions 42 and a second plurality of aligning impressions 44. The first plurality of aligning impressions 42 provide a stacking configuration for goods that are located entirely within a perimeter of the support surface 26. Alternatively, the first plurality of aligning impressions 42 could provide a stacking configuration for goods that extends beyond a perimeter of the pallet 10. In the illustrated embodiment, the first plurality of aligning impressions 42 are designed to accept five (5) gallon sized pails for storing a liquid, such as paint. A lower lip of the pail (not shown) would fit into a corresponding one of the first plurality of aligning impressions 42 when the pail is being stacked on the pallet 10.

The second plurality of aligning impressions 44 are also arcuate in shape and include a diameter that is larger than a diameter of the first plurality of aligning impressions 42. The second plurality of aligning impressions 44 are sized and positioned to accept larger containers than the first plurality of aligning impressions 42, such as barrels with a thirty (30) or more gallon capacity. In contrast to the first plurality of aligning impressions 42, the second plurality of aligning impressions 44 allow the barrels stacked thereon to extend beyond a perimeter of the support surface 26 while still maintaining the barrels in a desired location for improving balance and maneuverability of the pallet 10. Because the second plurality of aligning impressions 44 are much larger than the first plurality of aligning impressions 42, the first and second plurality of aligning impressions 42, 44 include multiple intersections where one of the first plurality of aligning impressions 42 crosses or intersections with one of the second plurality of aligning impressions 44. The first and second plurality of aligning impressions 42, 44 include a lower support surface 45 that shares a common plane and supports a base portion of one of the containers stacked thereon.

Although the first and second plurality of aligning impressions 42, 44 are shown as circular or arcuate shapes, the first and second plurality of impressions could be different shapes, such as square, rectangular, elliptical, or another geometric shape that matches the shape of the base of the goods stacked thereon.

Figure 4:
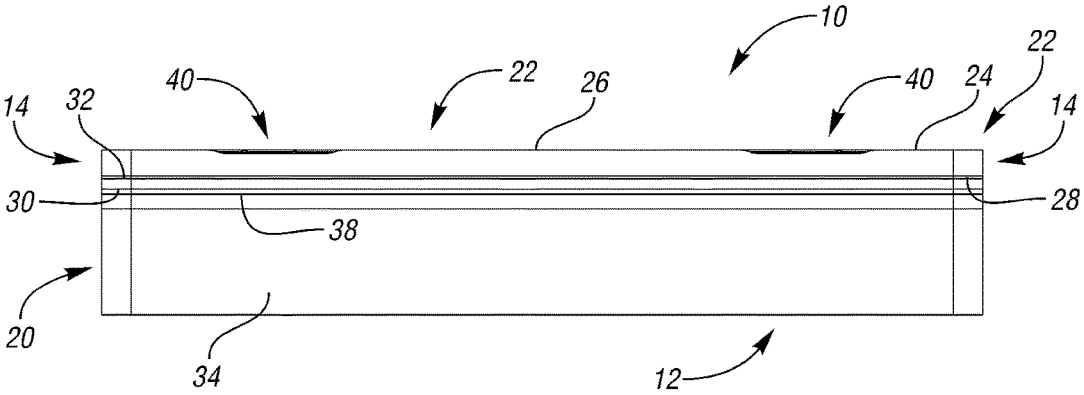
FIG. 4 is a side view of the pallet of FIG. 1.

FIG. 4 illustrates a side view of the pallet 10 showing one of the legs 34 extending between opposing end 14 of the pallet 10. In the illustrated embodiment, the legs 34 are continuous between the opposing ends 14 which can increase the rigidity of the pallet 10 and prevents the pallet 10 from bending. Additionally, composite or metal reinforcements (not shown) could be inserted along the length of the legs 34 to increase the rigidity of the pallet 10.

Figure 5:
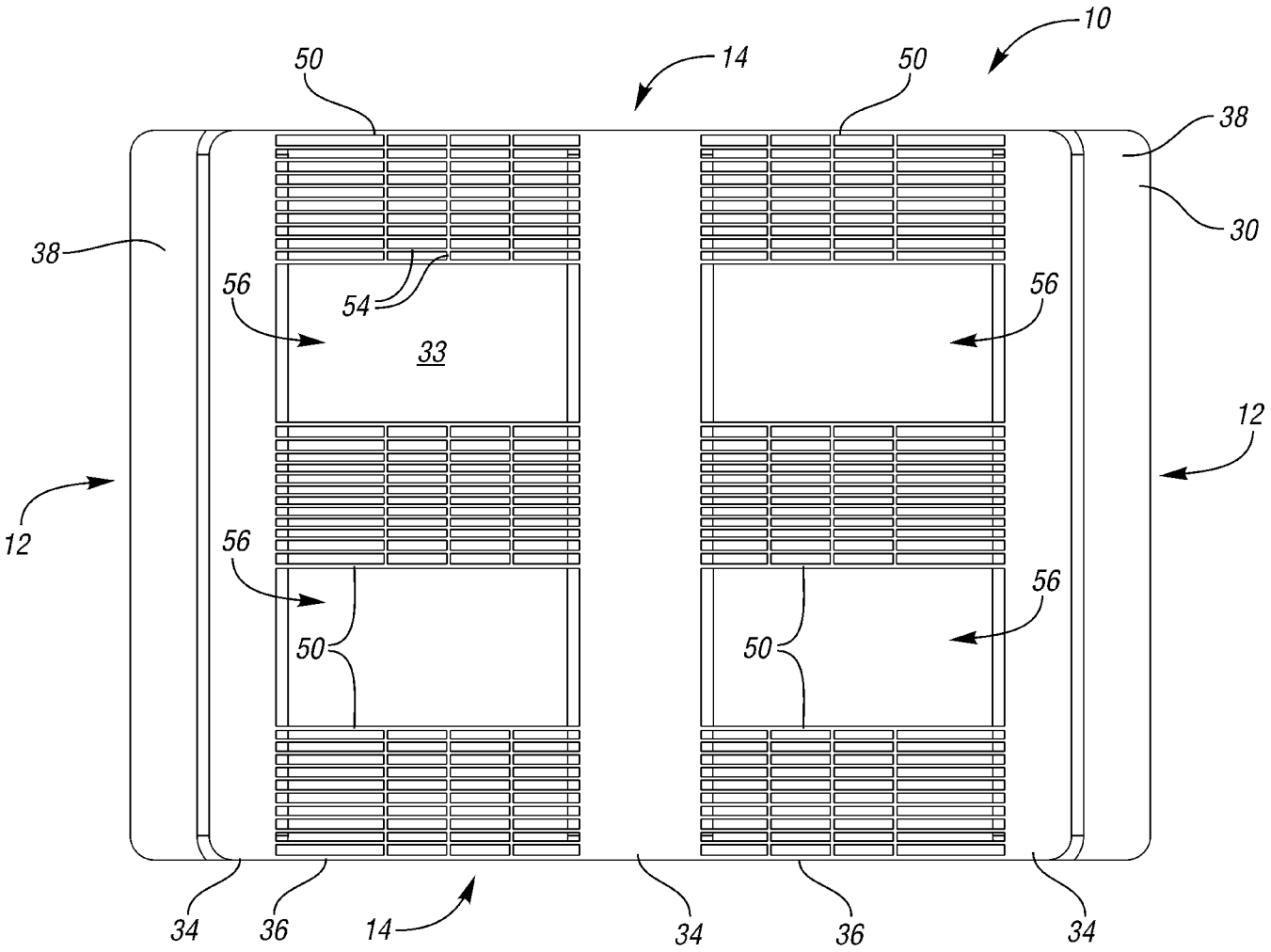
FIG. 5 is a bottom view of the pallet of FIG. 1.

FIG. 5 illustrates a bottom view of the pallet 10 showing the lower support 36 as a plurality of cross supports 50 extending between the legs 34. The plurality of cross supports 50 are part of the lower support 36 and include a smooth continuous surface 52 (FIG. 2) on an upper portion opposing the lower surface 33 and a plurality of ribs 54 extending downward from the smooth continuous surface 52 in a direction generally perpendicular to the smooth continuous surface 52.

The plurality of ribs 54 form a grid with a first plurality of ribs extending in a direction generally parallel to the sides 12 of the pallet 10 and a second plurality of ribs extending in a direction generally parallel to the ends 14 of the pallet 10. In the illustrated embodiment, the plurality of ribs 54 are spaced from a lower surface of the legs 34 and the lower support 36 includes three (3) cross supports 50 extending between adjacent pairs of legs 34 with openings 56 between adjacent cross supports 50. The openings 56 reduce the weight of the pallet 10 by reducing the amount of material in the lower support 36.

Figure 6:
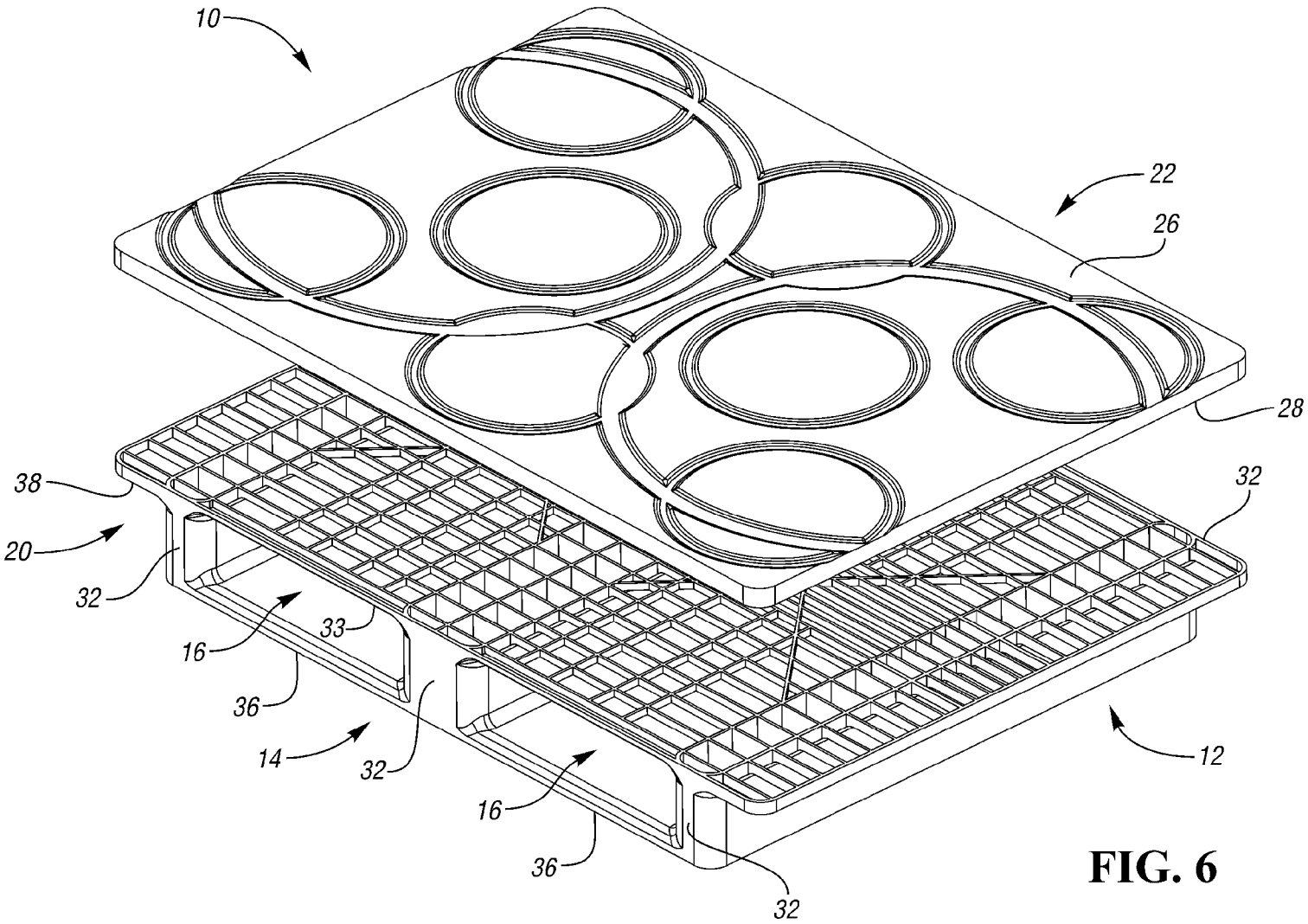
FIG. 6 is an exploded perspective view of the pallet of FIG. 1.
Figure 7:
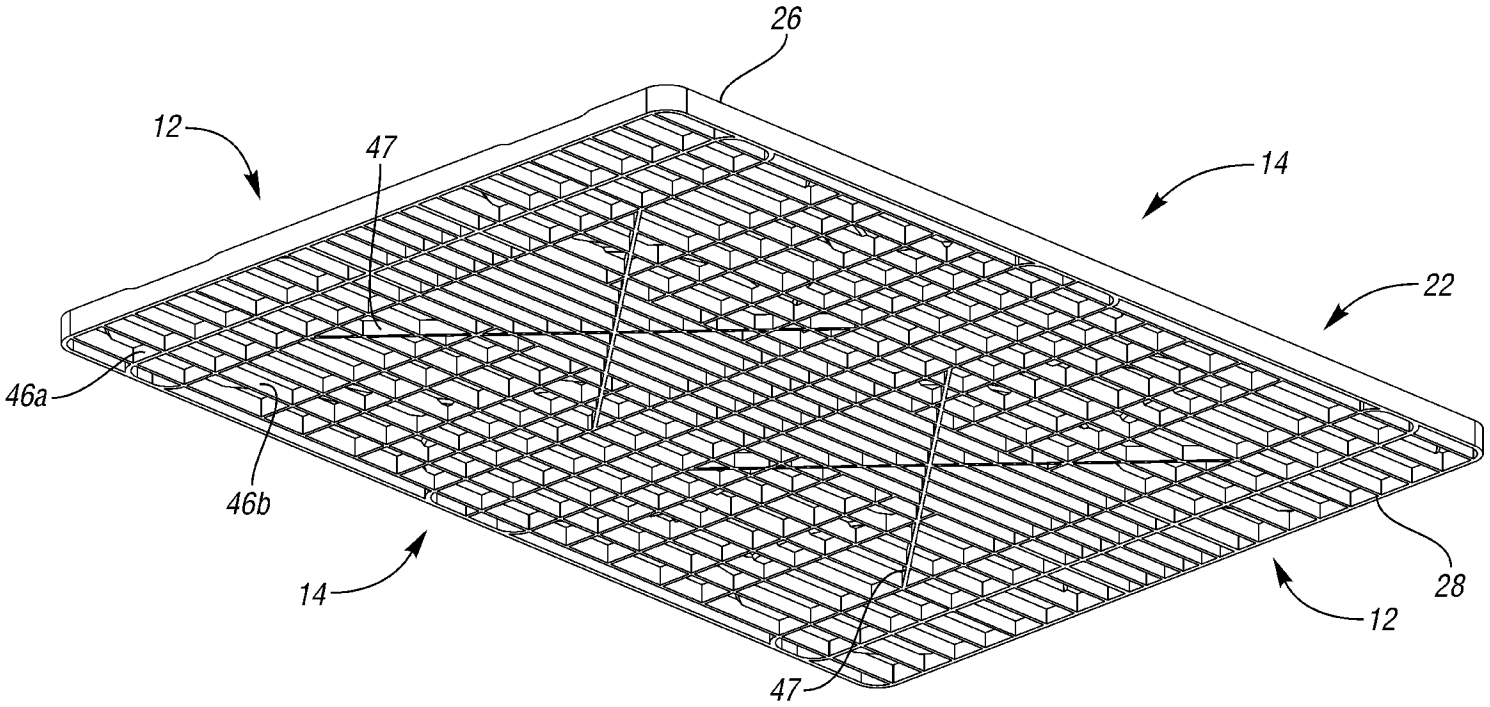
FIG. 7 is a perspective view of an upper structure of the pallet of FIG. 1.
Figure 8:
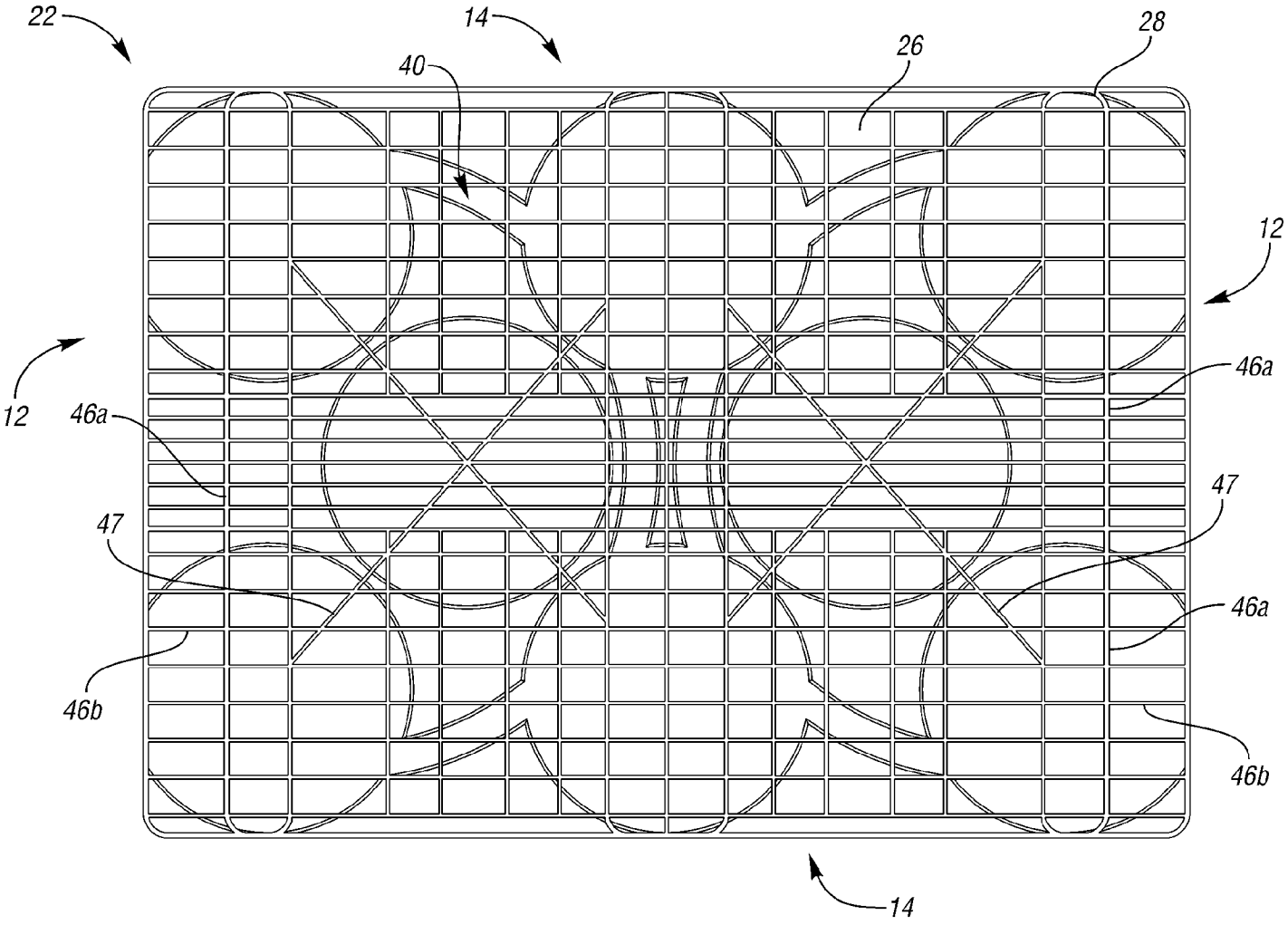
FIG. 8 is a bottom view of the upper structure of FIG. 7.

FIG. 6 illustrates an exploded view of the pallet 10 with the lower structure 20 separated from the upper structure 22. As shown in FIG. 7, the upper structure 22 includes a first plurality of ribs 46*a* that extend in a direction parallel to the sides 12 and a second plurality of ribs 46*b* that extend in a direction parallel to the ends 14. The first and second plurality of ribs 46*a*, 46*b* extend from the support surface 26 to the lower surface 28 and form a plurality of box shaped structures. Two pair of transverse ribs 47 each extend transverse to both the sides 12 and the ends 14. The first and second plurality of ribs 46*a*, 46*b* and the two pair of transverse ribs 47 contribute to the structural rigidity of the upper structure 22. As shown in FIG. 8, the plurality of aligning impressions 40 are recessed into the support surface 26.

Figure 9:
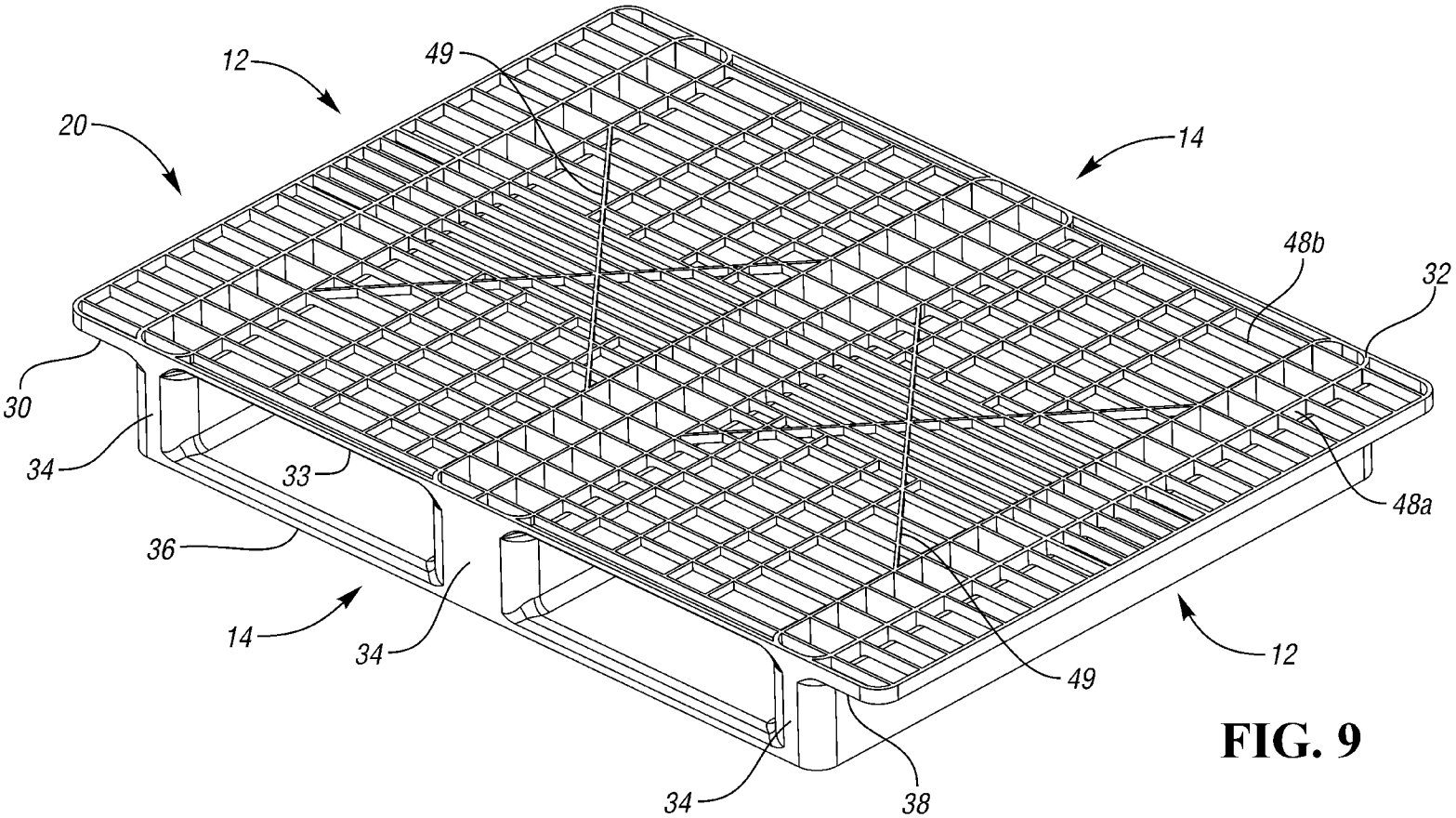
FIG. 9 is a perspective view of a lower structure of the pallet of FIG. 1.
Figure 10:
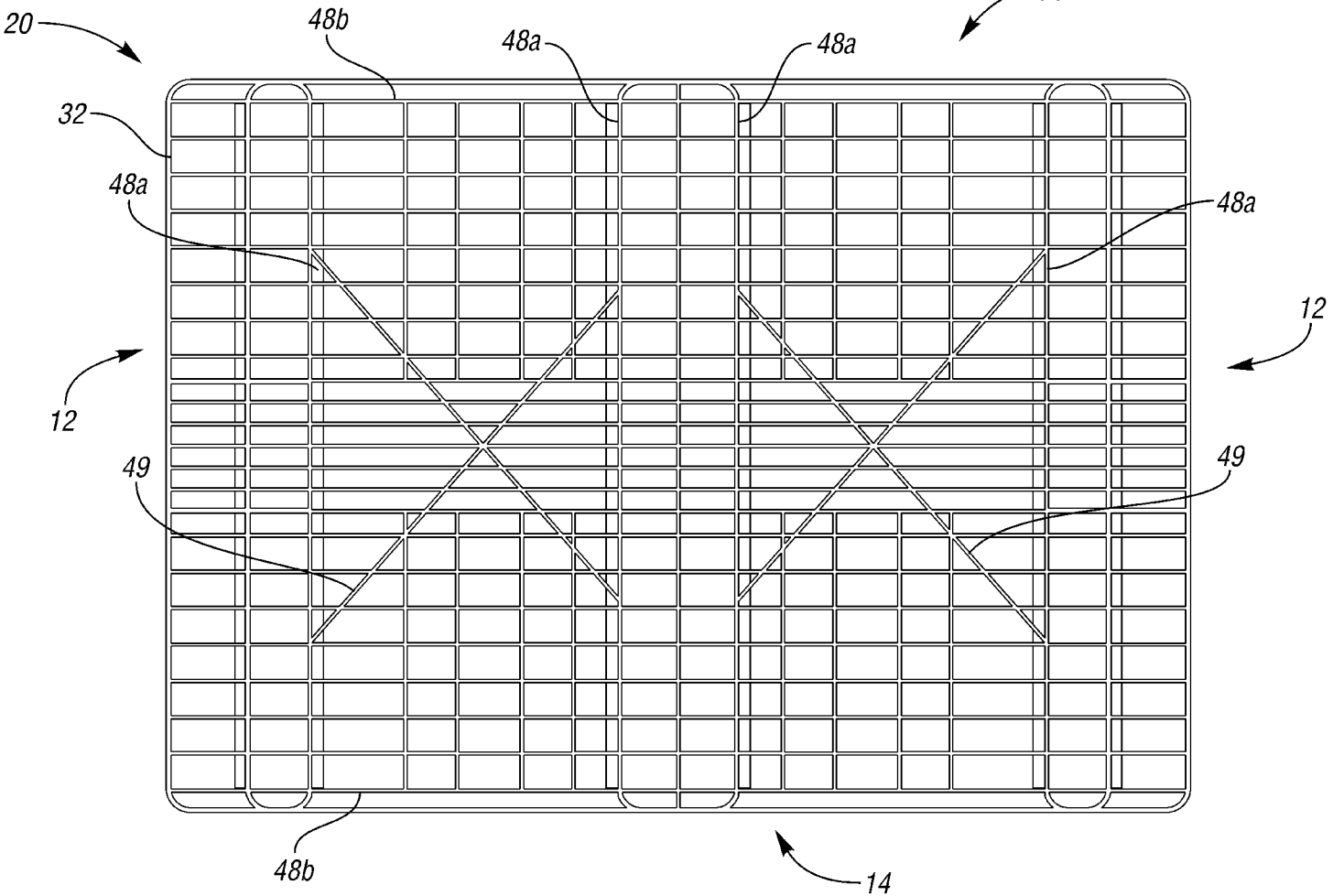
FIG. 10 is a top view of the lower structure of FIG. 9.
Figure 11:
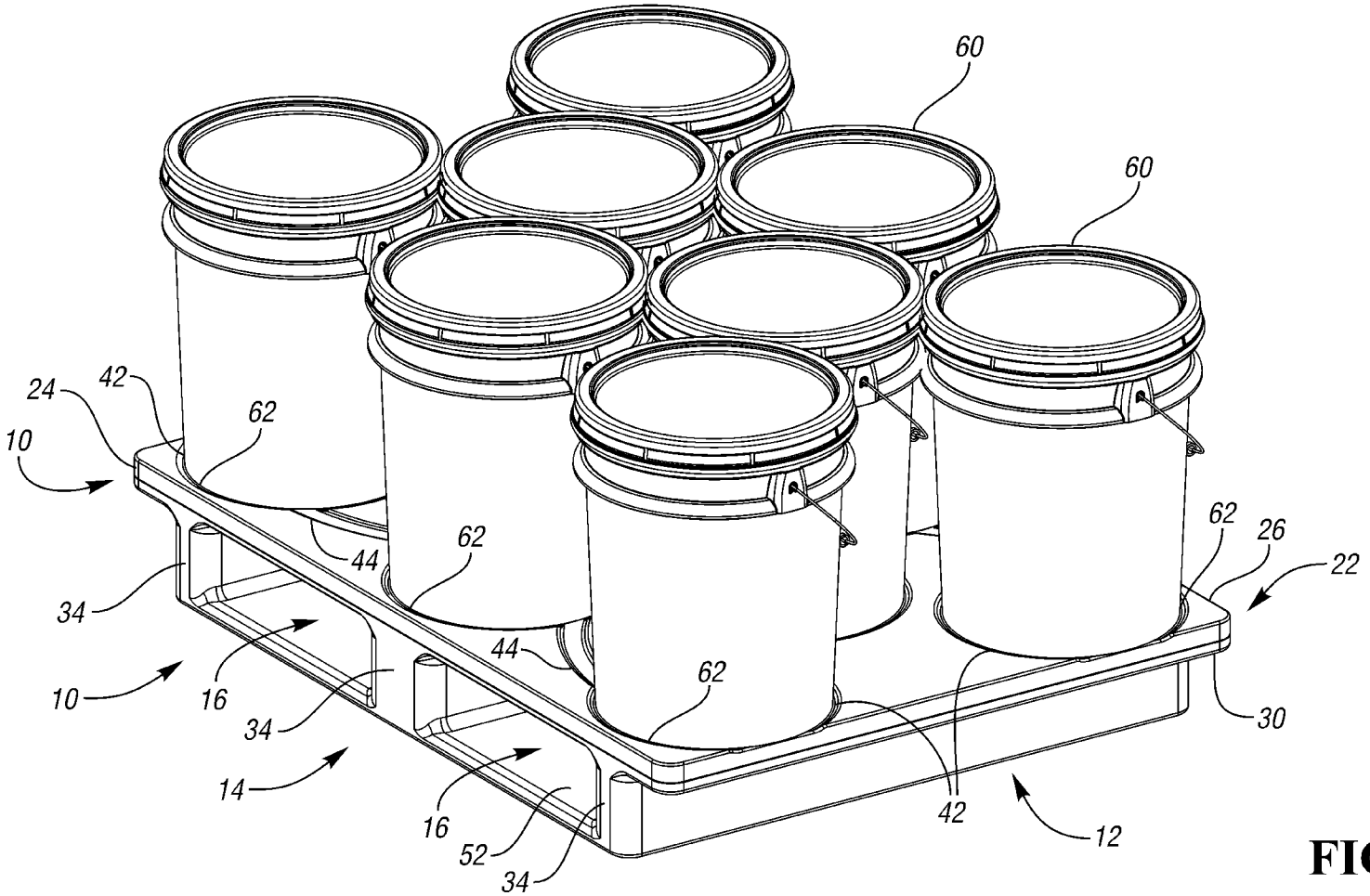
FIG. 11 is a perspective view of the pallet of FIG. 1 with a plurality of pails stacked thereon.

As shown in FIGS. 9 and 10, the lower structure 20 includes a first plurality of ribs 48*a* that extend in a direction parallel to the sides 12 and a second plurality of ribs 48*b* that extend in a direction parallel to the ends 14. The first and second plurality of ribs 48*a*, 48*b* extend from the lower surface 33 or the legs 34 to the upper surface 32 and form a plurality of box shaped structures. Two pair of transverse ribs 49 each include a rib that extends transverse to both the sides 12 and the ends 14. In the illustrated embodiment, the two pair of transverse ribs 49 extend between corresponding pairs of the second plurality of ribs 48*b*. The corresponding pairs of the second plurality of ribs 48*b* extend into one of the legs 34. The first and second plurality of ribs 48*a*, 48*b* and the two pair of transverse ribs 49 contribute to the structural rigidity of the lower structure 20.

When the lower structure is mated with the upper structure 22, the first and second plurality of ribs 46*a*, 46*b* on the upper structure 22 mate with a corresponding one of the first and second plurality of ribs 48*a*, 48*b* on the lower structure 20 to form a plurality of box beam structures. The two pair of transverse ribs 47 on the upper structure 22 and the two pair of transverse ribs 49 on the lower structure 20 can also be joined together when the upper structure 22 is joined to the lower structure 20.

Figure 12:
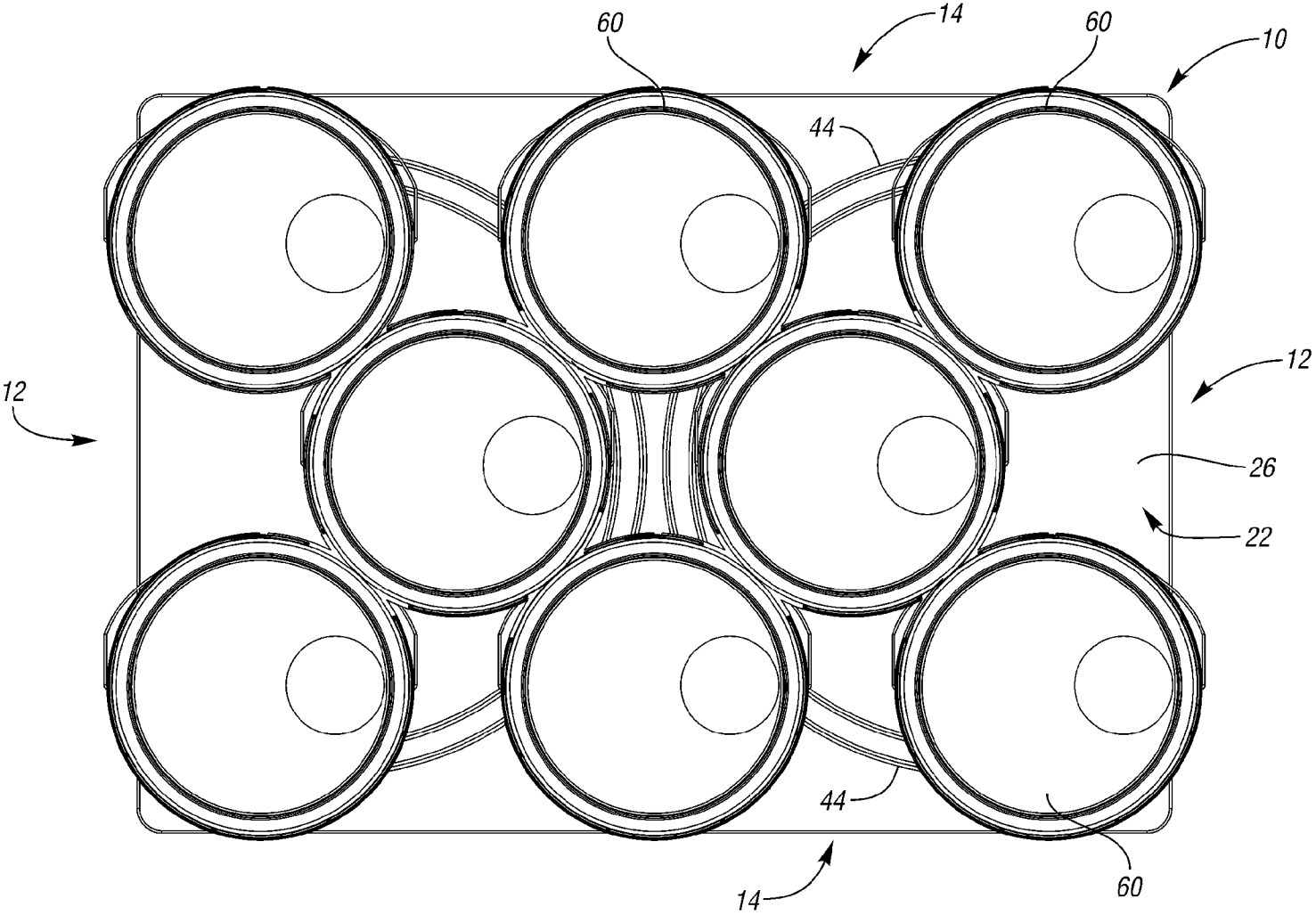
FIG. 12 is a top view of the pallet of FIG. 1 with the plurality of pails stacked thereon.
Figure 13:
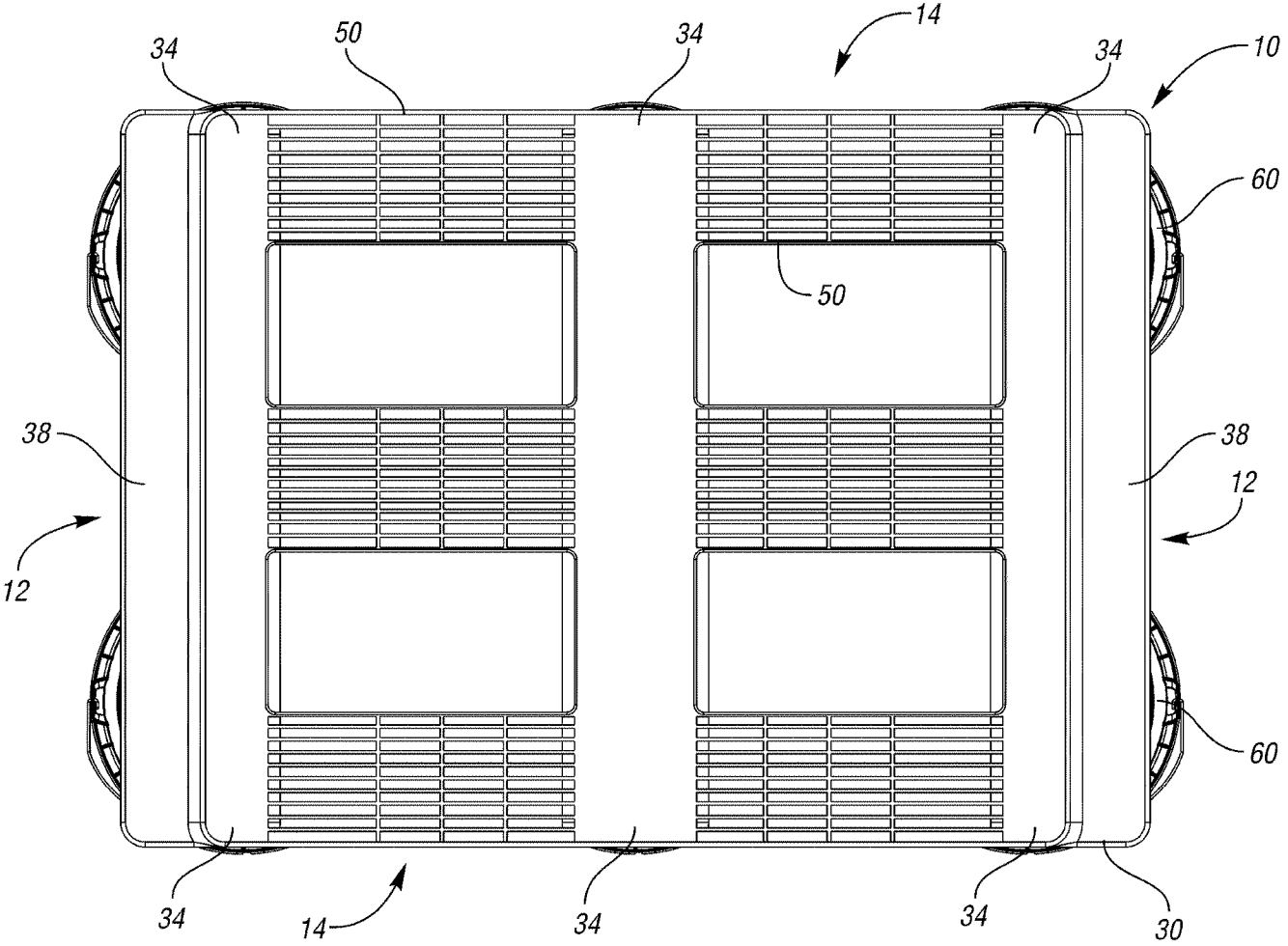
FIG. 13 is a bottom view of the pallet of FIG. 1 with the plurality of pails stacked thereon.
Figure 14:
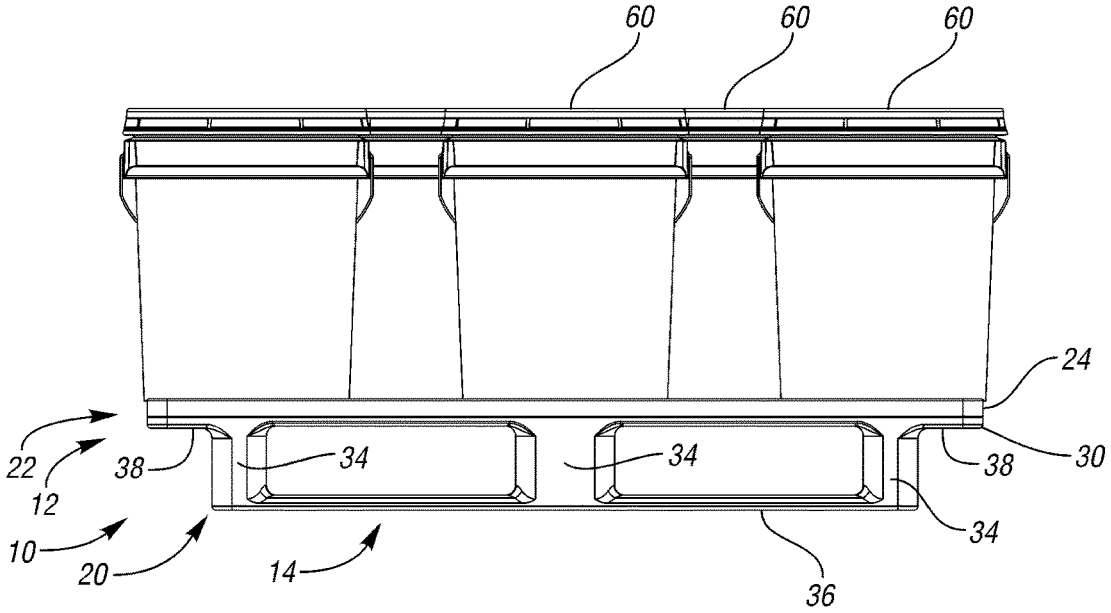
FIG. 14 is a front view of the pallet of FIG. 1 with the plurality of pails stacked thereon.
Figure 15:
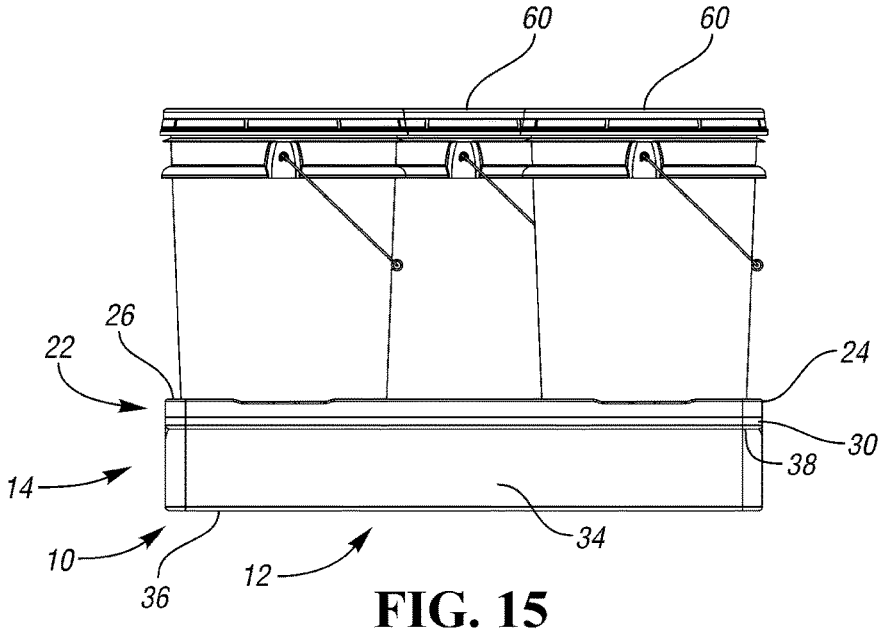
FIG. 15 is a side view of the pallet of FIG. 1 with the plurality of pails stacked thereon.
Figure 16:
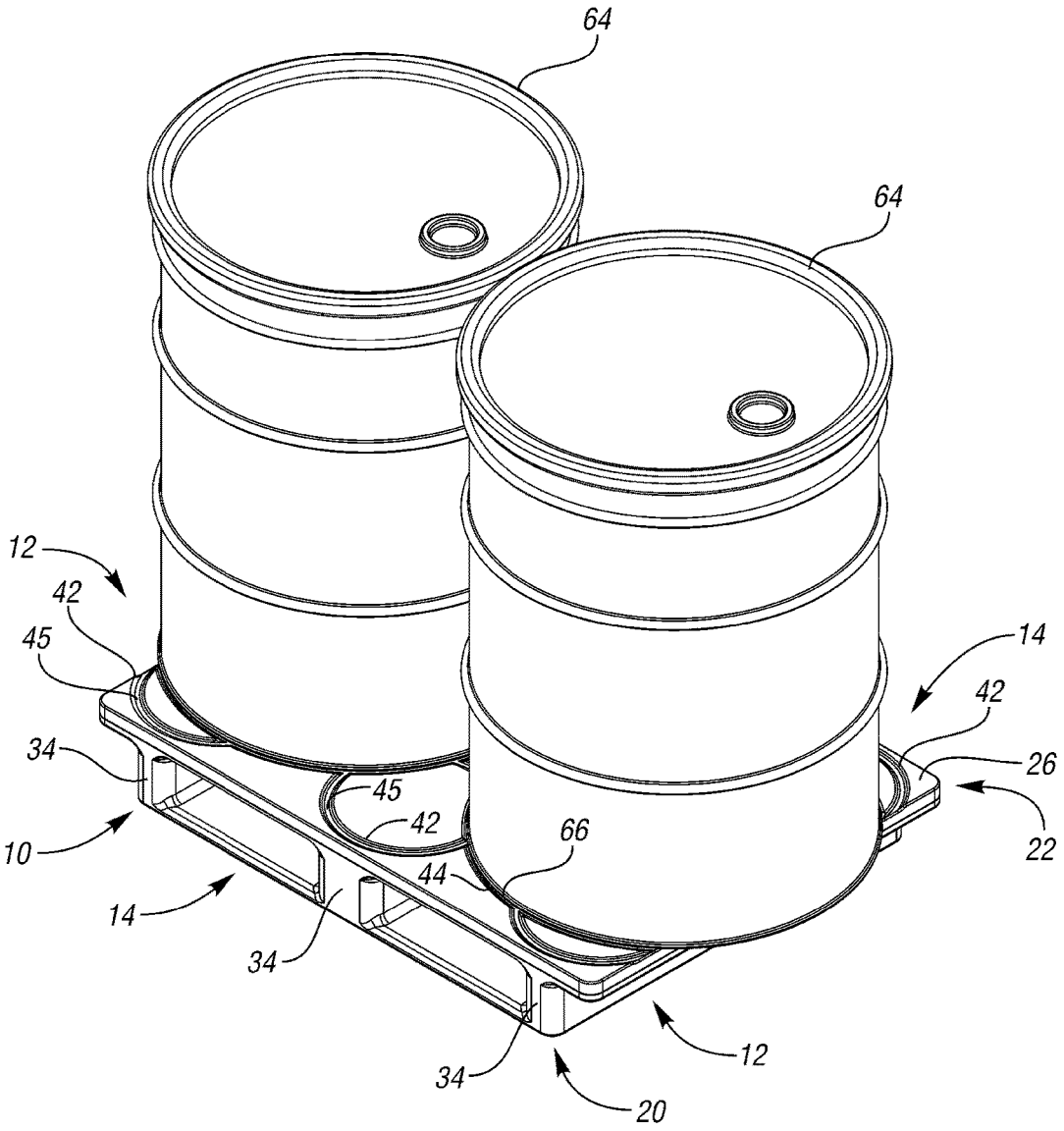
FIG. 16 is a perspective view of the pallet of FIG. 1 with a pair of barrels stacked thereon.

FIG. 11-15 illustrate a plurality of pails 60 located on the support surface 26 of the pallet 10. A lower perimeter of the pails 60 include a lip 62 that is received in or nests with the first plurality of aligning impressions 42 to provide a passive locating function when loading the pails 60 onto the pallet 10. As shown in FIG. 14, the pails 60 along the ends 14 and center of the pallet 10 are aligned with the legs 34 to provide additional support when carrying the pallet 10 loaded with the pails 60. Only the two pails 60 located inward from a perimeter of the support surface 26 and spaced from the center leg 34 are not aligned with the legs 34 as shown in FIGS. 12 and 13.

Figure 17:
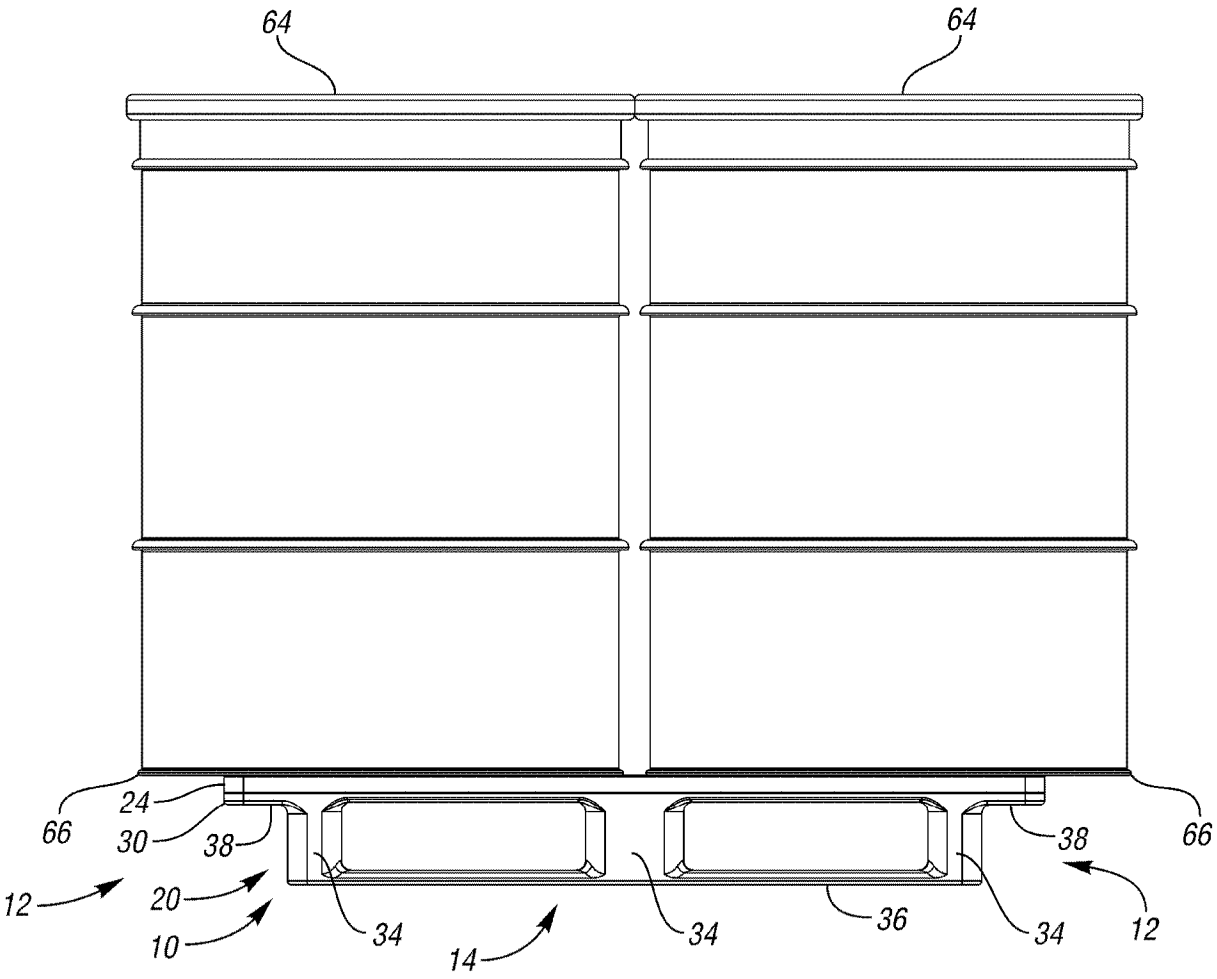
FIG. 17 is a front view of the pallet of FIG. 1 with the pair of barrels stacked thereon.
Figure 18:
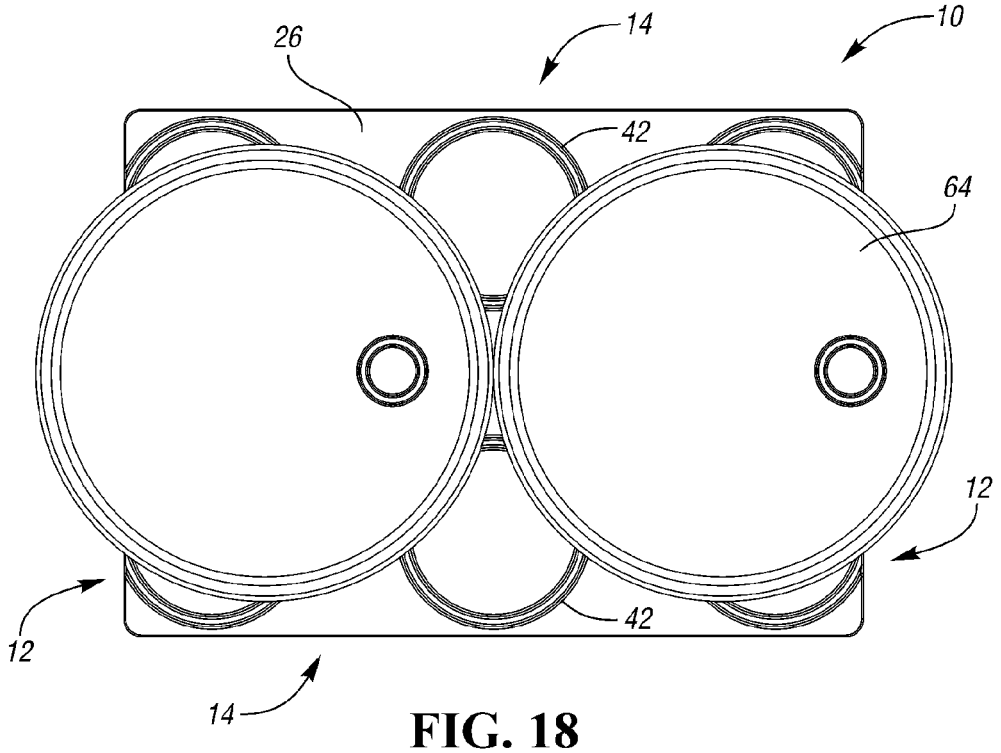
FIG. 18 is a top view of the pallet of FIG. 1 with the pair of barrels stacked thereon.
Figure 19:
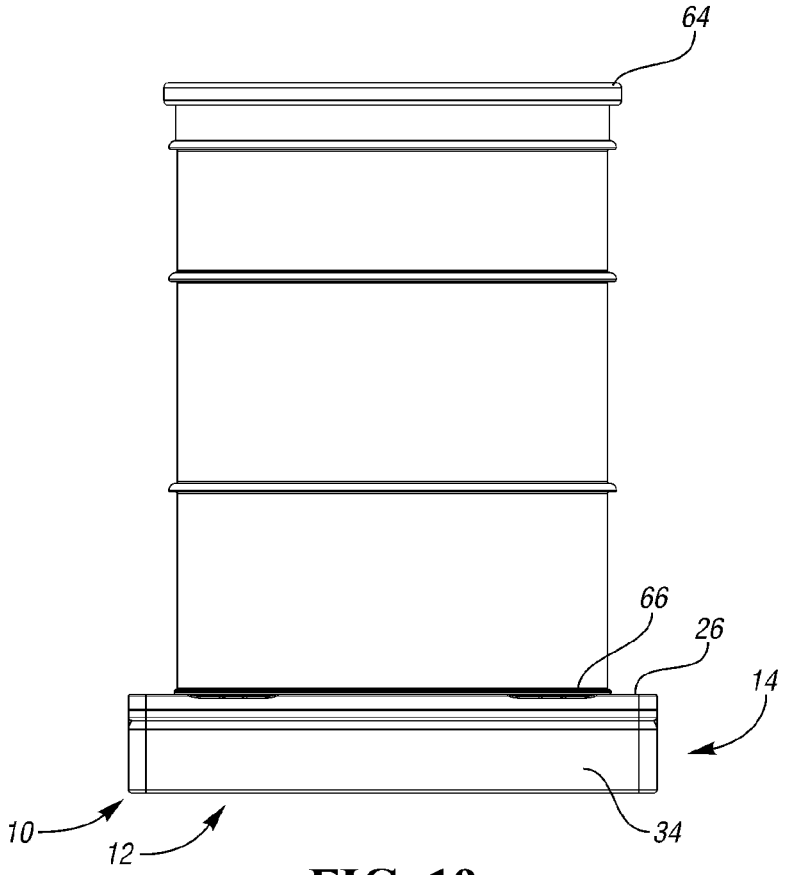
FIG. 19 is a side view of the pallet of FIG. 1 with the pair of barrels stacked thereon.
Figure 20:
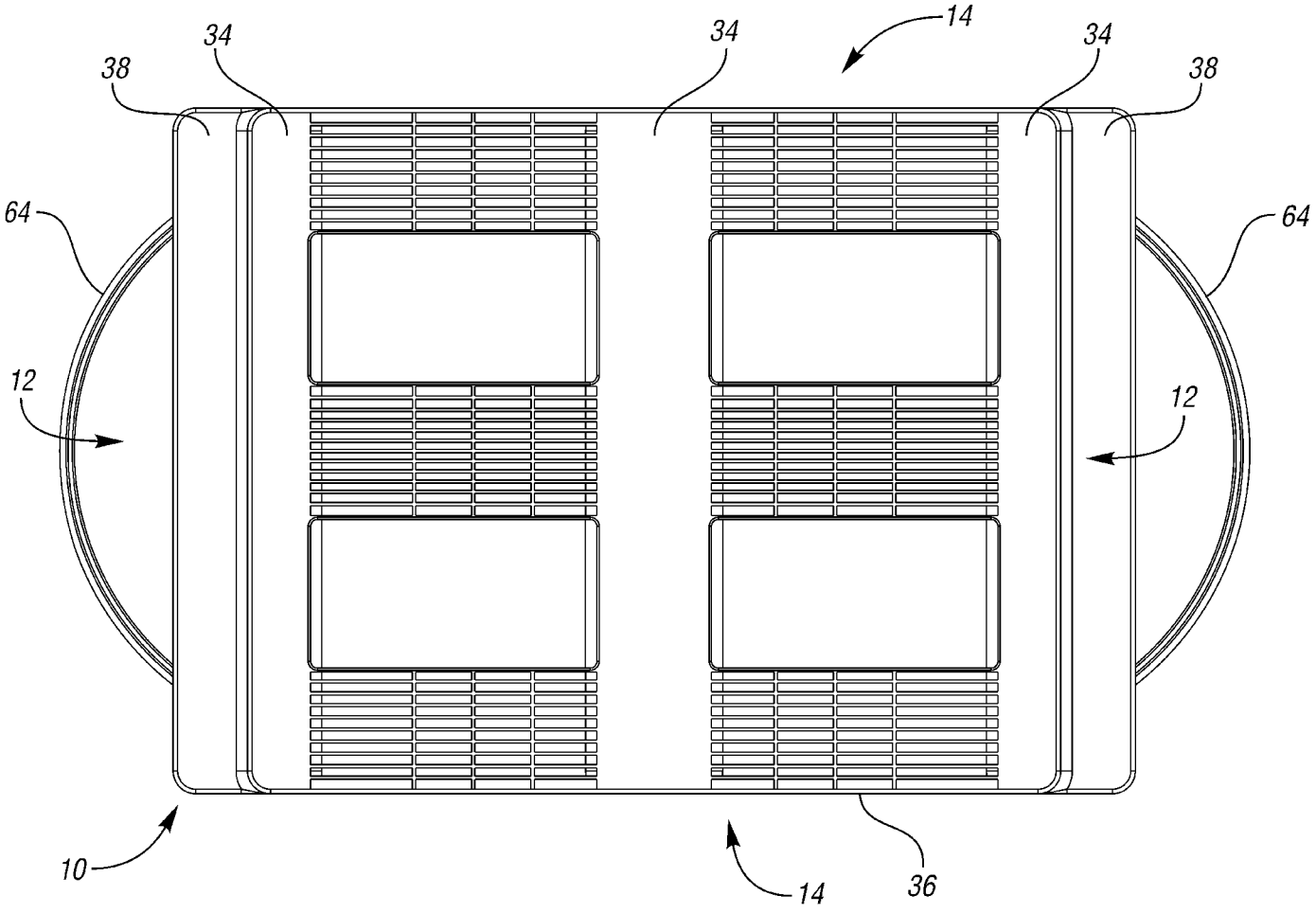
FIG. 20 is a bottom view of the pallet of FIG. 1 with the pair of barrels stacked thereon.

As shown in FIG. 16-20, the pallet 10 may also support a pair of barrels 64. A lower perimeter of each of the barrels 64 includes a lip 66 that is received in or nests with the second plurality of aligning impressions 44 on the lower support surface 45 to provide a passive locating function when loading the barrels 64 onto the pallet 10. As shown in FIG. 17, each of the barrels 64 extend over one of the legs 34 adjacent the sides 12 and a portion of the leg 34 extending along a middle or center of the pallet 10. Additionally, a portion of each of the barrels 64 extends beyond the support surface 26 along the sides 12 of the pallet 10. Without the addition of the first and second upper deck portions 24 and 30 extending beyond the legs 34 a distance D3 forming wings, the stability of the barrels 64 would be reduced. The second plurality of aligning impressions 44 and the lip 66 also keep the barrels 64 positioned evenly on the pallet 10 to distribute the weight evenly for balance. Without the second plurality of aligning impressions 44, the success of carrying such high product overhang will be difficult to achieve consistently. In other words, the second plurality of aligning impressions 44 eliminate human error and therefore create a consistent balance every time barrels 64 are transported via the pallets 10.

Figure 21:
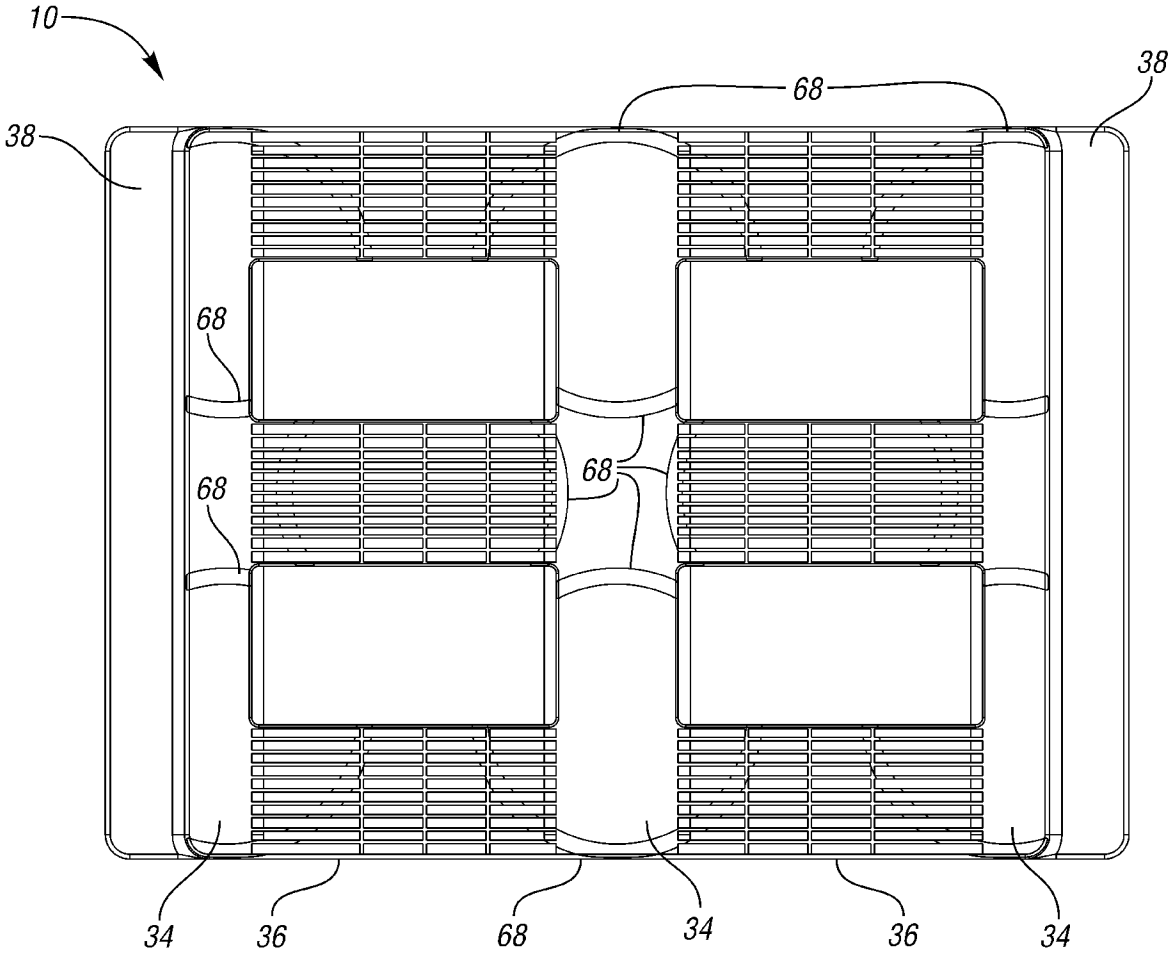
FIG. 21 is a bottom view of the pallet of FIG. 1 with contact portions of a lid of one of the pails highlighted on the lower support of the pallet.

FIG. 21 illustrates a bottom view of the pallet 10 with contact portions 68 of a lid of one of the pails 60 highlighted on the legs 34 and the lower support 36 of the pallet 10. When comparing the contact portions 68 on the pallet 10 to a traditional wood pallet with wooden elongated legs on the bottom, the pallet 10 significantly increases the amount of contact the lids on the pails 60 have with the legs 34 and the lower support 36. The increased contact area improves the stability of the pallet 10 stacked on pails or other goods. The pallet 10 distributes a top load more evenly and consistently across the lids on the pails 60 when compared to wooden pallets which create an inconsistent surface area for lids of the pails 60 to engage the wooden pallet. In other words, the pallet 10 distributes the top load for a more secure and consistently distributed unit load when compared to a traditional wooden pallet.

Figure 22:
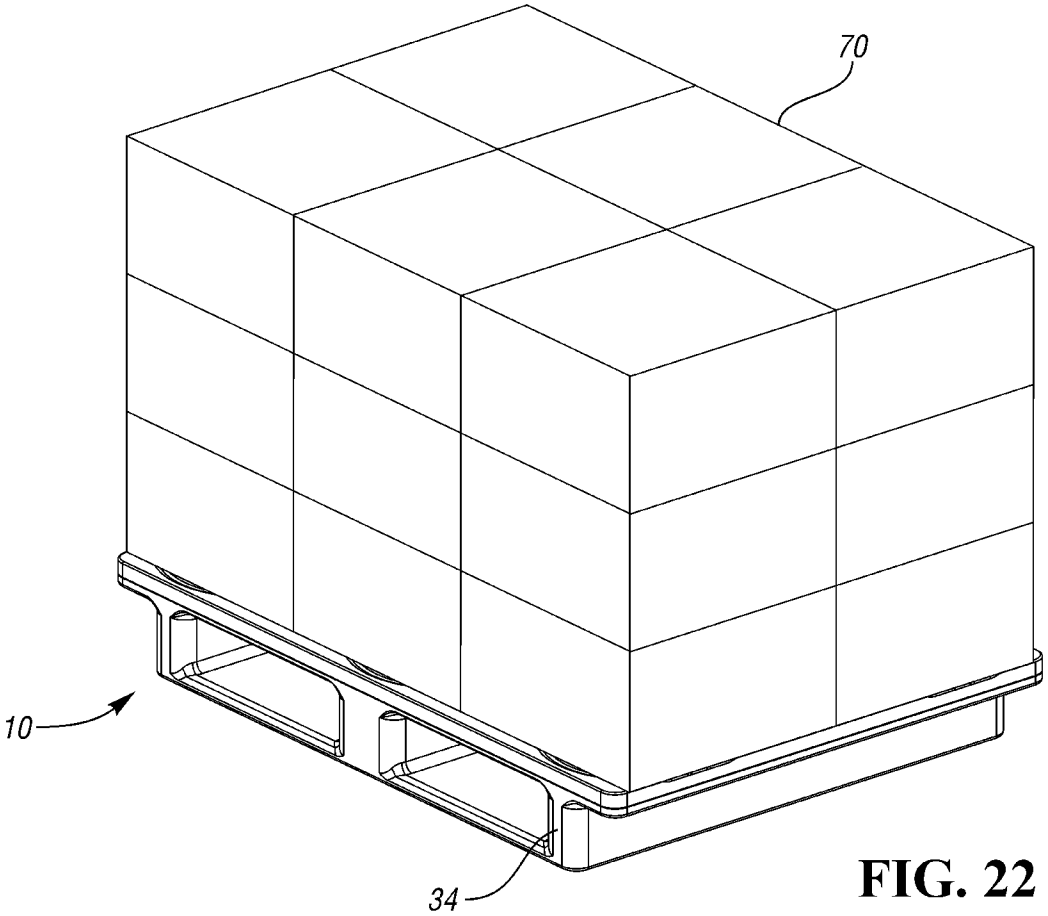
FIG. 22 is a perspective view of a plurality of boxed goods stacked on the pallet of FIG. 1.

Although the illustrated embodiments show pails 60 or barrels 64 stacked on the pallet 10, boxed goods 70 or other goods can also be stacked on the pallet 10 as shown in FIG. 22. When stacking the boxed goods 70 onto the pallet 10, the plurality of aligning impressions 40 do not interfere with stacking of the boxed goods 70 because the plurality aligning impressions 40 are recessed into the support surface 26.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A pallet comprising:

an upper portion including an upper surface for supporting containers thereon;

a first plurality of recesses in the upper surface having a first lower support surface spaced from the upper surface and at least one of the first plurality of recesses intersects a perimeter edge of the upper surface; and a plurality of legs extending downwardly from the upper portion, wherein the upper portion includes an overhang extending outward from one of the plurality of legs extending along opposing sides of the pallet.

2. The pallet of claim 1, including a second plurality of recesses on the upper surface, wherein the first plurality of recesses at least partially circumscribe a first shape having a first dimension and the second plurality of recesses at least partially circumscribe a second shape having a second dimension greater than the first dimension and at least one of the second plurality of recesses includes opposing ends that intersect the perimeter edge of the upper surface.

3. The pallet of claim 2, wherein at least one of the first plurality of recesses and at least one of the second plurality of recesses follows an arcuate shape recessed into the upper surface.

4. The pallet of claim 3, wherein the second plurality of recesses includes a second lower support surface spaced from the upper surface, the first lower support surface and the second lower support surface extend in a common plane.

5. The pallet of claim 2, wherein the first plurality of recesses intersect the second plurality of recesses.

6. The pallet of claim 1, where the first plurality of recesses includes pairs of first recesses that are centered on at least one of the plurality of legs.

7. The pallet of claim 1, wherein the upper portion includes an upper structure having a first upper deck portion defining the upper surface and a lower structure having a second upper deck portion that mates with the first upper deck portion.

8. The pallet of claim 7, wherein a lower side of the first upper deck portion includes a first plurality of ribs that mate with a second plurality of ribs on an upper side of the second upper deck portion to form a plurality of box shaped structures.

9. A pallet comprising:

an upper portion including an upper surface for supporting containers thereon, wherein the upper portion includes an upper structure having a first upper deck portion defining the upper surface and a lower structure having a second upper deck portion that mates with the first upper deck portion;

a first plurality of recesses in the upper surface having a first lower support surface spaced from the upper surface, wherein the first plurality of recesses at least partially circumscribe a first shape having a first dimension;

a second plurality of recesses in the upper surface having a second lower support surface spaced from the upper surface, wherein the second plurality of recesses at least partially circumscribe a second shape having a second dimension greater than the first dimension and the first lower support surface and the second lower support surface are located in a common plane and the first lower support surface and the second lower support surface intersect; and a plurality of legs extending downward from the upper portion, wherein the plurality of legs includes a leg extending along each side of the pallet and the upper surface extends outward from an outer surface of each of the legs to form an overhang.

10. The pallet of claim 9, wherein the first plurality of recesses at least partially form a ring and at least one of the first plurality of recesses intersects the perimeter edge of the upper surface.

11. The pallet of claim 10, wherein at least one of the first plurality of recesses intersects the perimeter edge of the upper surface and at least one of the second plurality of recesses includes opposing ends that intersect a perimeter edge of the upper surface.

12. The pallet of claim 9, wherein a lower side of the first upper deck portion includes a first plurality of ribs that mate with a second plurality of ribs on an upper side of the second upper deck portion to form a plurality of box shaped structures.

13. The pallet of claim 9, wherein at least one of the first plurality of recesses and at least one of the second plurality of recesses follows an arcuate shape recessed into the upper surface.

14. A method of storing goods on a pallet comprising the steps of:

selecting a predetermined location on an upper surface of an upper portion of the pallet to accept a container, wherein the predetermined locating includes at least one first recess circumscribing a first shape having a first dimension for accepting a base portion of the container and a plurality of legs extending downwardly from the upper portion and at least one of the first plurality of recesses intersects a perimeter edge of the upper surface; and nesting a base portion of the container in the predetermined location.

15. The method of claim 14, wherein the predetermined location includes at least one second recess circumscribing a second shape for accepting a second container having a second dimension greater than the first dimension and the at least one second recess includes opposing ends that intersect the perimeter edge of the upper surface.

16. The method of claim 15, wherein nesting the base portion of the container in the at least one second recess includes the base portion of the container overhanging the perimeter edge of the upper surface.

17. The method of claim 14, including supporting a portion of the base of the container on a first lower support surface of the at least one first recess, wherein the plurality of legs includes a leg extending along each side of the pallet and the upper surface extends outward from an outer surface of each of the legs forming an overhang.

18. The method of claim 17, including storing the pallet on a rack system and accepting a portion of the rack into a void at least partially defined by the overhang and one of the plurality of legs.

19. The method of claim 14, wherein the predetermined location includes a pair of first recesses centered on at least one of a plurality of legs.

* * * * *